United States Patent [19]

Van Ginkel et al.

[11] 4,328,654

[45] May 11, 1982

[54] BAG CLOSING APPARATUS

[75] Inventors: Mannes Van Ginkel; Jan Plug, both of Barneveld, Netherlands

[73] Assignee: Moba Holding Barneveld B.V., Barneveld, Netherlands

[21] Appl. No.: 112,476

[22] Filed: Jan. 16, 1980

[30] Foreign Application Priority Data

Jan. 29, 1979 [NL] Netherlands ..... 7900674

[51] Int. Cl.[3] ..... B65B 7/06; B65B 51/00

[52] U.S. Cl. ..... 53/285; 53/138 A; 53/371; 53/372; 53/378

[58] Field of Search ..... 53/379, 285, 378, 372, 53/373, 570, 138 R, 138 A, 266 R, 390

[56] References Cited

U.S. PATENT DOCUMENTS

| | | | |
|---|---|---|---|
| 2,627,154 | 2/1953 | Rose et al. | 53/378 X |
| 2,899,785 | 8/1959 | Gebhardt | 53/138 A X |
| 2,924,924 | 2/1960 | Garapolo et al. | 53/138 A X |
| 3,175,338 | 3/1965 | Ahlgren et al. | 53/226 X |
| 3,520,106 | 7/1970 | Aalpoel | 53/379 X |
| 3,668,818 | 6/1972 | Holmes | 53/138 A X |
| 3,942,302 | 3/1976 | Bloom | 53/138 A |
| 3,948,019 | 4/1976 | Döring et al. | 53/570 X |
| 4,107,903 | 8/1978 | Wickersheim | 53/138 A |
| 4,125,986 | 11/1978 | Sheetz | 53/138 A X |
| 4,141,194 | 2/1979 | Rochman | 53/138 A X |
| 4,223,508 | 9/1980 | Wells | 53/138 R |

*Primary Examiner*—Horace M. Culver

*Attorney, Agent, or Firm*—Larson and Taylor

[57] ABSTRACT

The invention relates to apparatus for closing a filled bag, the content of which may be an item of dressed poultry. The apparatus comprises a bottom member for supporting the bag during the closing operation. First and second sets of gripping means arranged one above the other and opposing members of each of which sets are operative to move toward and away from each other to respectively bunch together a portion of the bag located above the content. One set of gripping means is operative to move upward and away from the other set such that while this operation is taking place the lower set hold the bag and its contents firmly and the upper set pull the bag tautly over the content. Means for severing excess material above the bunched portion and a pointed pin to pierce and support the severed upper portion of the bag are additionally provided.

7 Claims, 5 Drawing Figures

BAG CLOSING APPARATUS

The invention relates to apparatus for closing a filled bag and which is provided with gripping means for bunching the top portion of the bag together and means for closing the top portion of the bag.

Amongst other apparatus of this type, such apparatus is known from Dutch Patent Application No. 74,10090.

In the closing of a filled bag, there very often occurs the problem of meeting the requirement that the bag should be pulled taut over the content therein. The ability to meet this requirement leads to a correct external appearance of the bag, which appearance is of great importance in the packing of dressed poultry for example.

The object of the invention is to provide apparatus by which the bag is pulled taut over the contents thereof in a reliable and efficient manner.

According to the invention therefore there is provided that the said gripping means comprises a first set of gripping members and a second set of gripping members, of which the first said set lie further from the content of the bag than the said second set, in which the first and second set of gripping means can be moved apart, and in which the closing means is arranged between the first and second sets of gripping members and operative when these sets of gripping members are in their moved-apart condition.

According to a further aspect of the invention and in order to prevent the bag being torn apart, while the said second set of gripping members are operative to bunch the top portion of the bag together, they do not grip the latter to the extent that it cannot slide therethrough.

In a preferred embodiment of the apparatus, the gripping members of the first set are constituted by members having a V-form, which are movable toward and away from each other and in which the first member comprises two plates arranged in mutually spaced relationship to each other, each with an edge of V-form, and the other member comprising a plate having an edge of V-form movably arranged between the first mentioned plates.

The second set of gripping members are preferably also of V-form and movable toward and away from each other, and are still more preferably rounded-off or chamfered, at least over foot portions of the V in order to prevent damage to the bag.

In one embodiment of the invention, the first set of gripping members is arranged in a carrier therefor which is displaceable with respect to the second set of gripping members.

In many cases, the bag closing means, as known per se, will not only close the bag by winding an adhesive tape around for example the bunched top portion, but will also cut the so closed bag above the closure. In order to hold the cut-off portion of the bag, and according to yet a further aspect of the invention, a pointed pin is provided which pin is affixed to one of the first set of gripping members and can preferably be withdrawn from the cut-off portion of the bag material by means of a divesting member therefor which operates on a return movement of the concerned one of the gripping members.

The invention is now further to be described with reference to the accompanying drawings in which.

Figure 1:
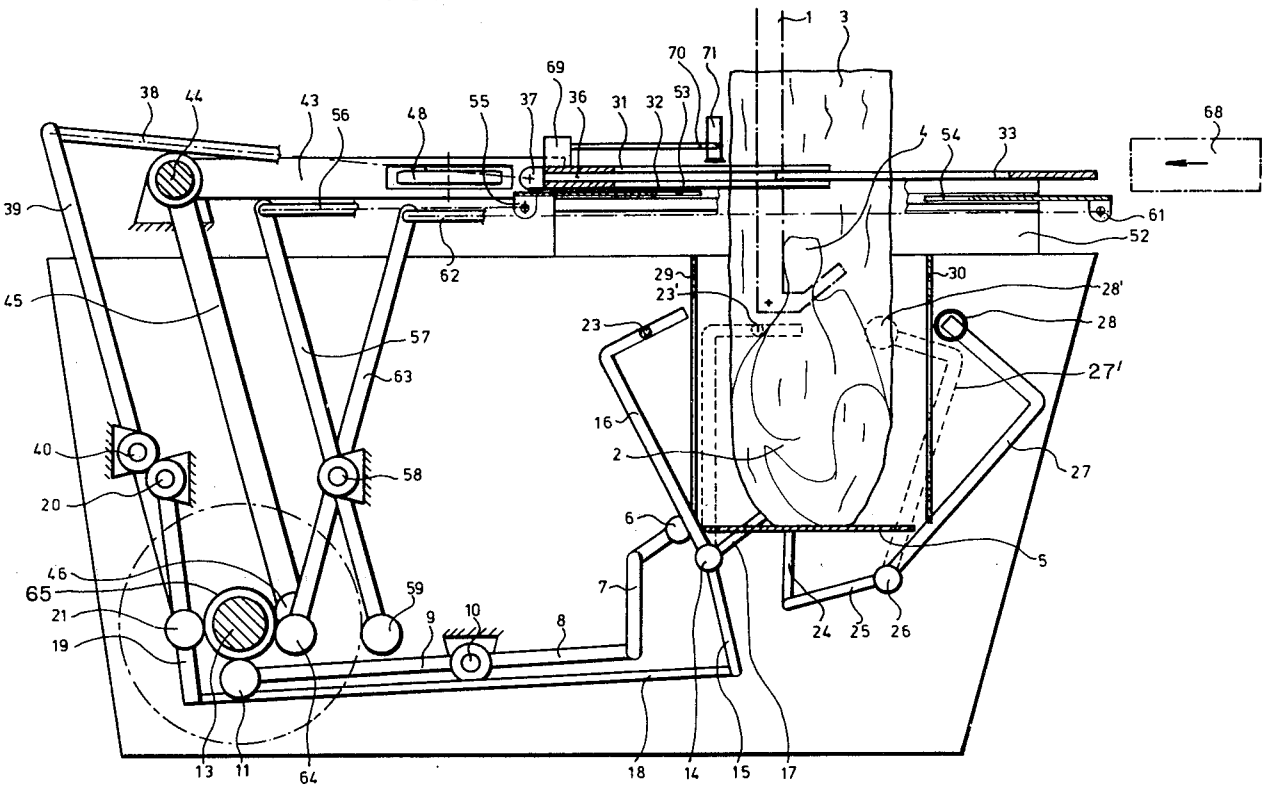
FIG. 1 is a schematic cross sectional view taken along line 2–2 of FIG. 1, of an apparatus according to the invention in its initial operative condition.
Figure 2:
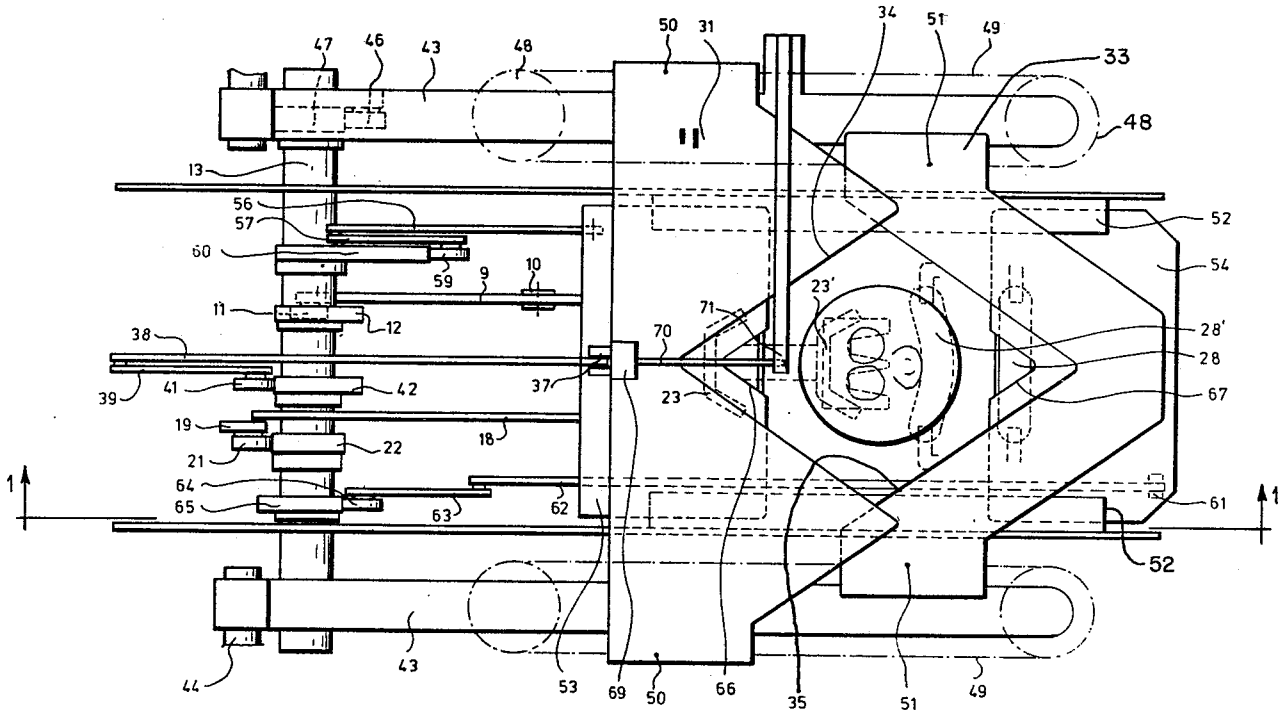
FIG. 2 is a plan view of FIG. 1.

Referring in the first instance to FIGS. 1 and 2, a hook 1 is shown, from which there hangs by its leg joints 4 an item of dressed poultry 2 accomodated in a bag 3. By means not shown, the hook 1 is arranged to free itself from the leg joints 4 and thereafter to move upward by means provided therefor. Constructions which achieve these movements are described in Dutch Patent Application No. 71 12520.

The item of poultry 2 is supported on a downwardly foldable bottom member 5 which is pivotably mounted on a hinge-pin 6 and is able to jointly pivot with an arm 7 which is pivotably connected to a connecting-rod 8. This last mentioned integer is in turn pivotably coupled to a double-lever 9 which is pivotable about a fixed hinge-pin 10 and carries a cam-following roller 11 operatively engaging the periphery of a rotatable cam 12 (see FIG. 2) affixed to a driven shaft 13.

A shaft 14 pivotably carries three arms 15, 16 and 17 thereon, said arms being coupled in fixed relationship one to another. The arm 15 is connected to a coupling-rod 18 which is in turn connected to an arm 19 which is pivotably mounted on a fixed support member 20 and carries a cam-following roller 21. This cam-following roller 21 operatively engages the periphery of a cam 22 (see FIG. 2). The arm 16 carries a forked-member 23 thereon. Another coupling-rod 24 is connected to the arm 17 and further connected to an arm 25 pivotably mounted on a fixed support member 26. The arm 25 is further connected to an arm-carrier 27 which accomodates a tension-spring 28.

The forked-member 23 and the arm-carrier 27, with the tension-spring 28, which is provided with a covering to prevent pinching between the spirals thereof, are enabled to move in through openings in the support plates 29 and 30, respectively, under the action of the cam 22, which movements bring them into the positions indicated by the reference numerals 23′ and 28′ respectively, at which positions they hold the item of poultry fast in the bag.

A set of plates 31 and 32 are rigidly affixed to one another and arranged for horizontal displacement. A plate 33 lies therebetween and is horizontally displaceable in a direction opposite to that of the plates 31 and 32. The pair of plates 31 and 32 on the one hand and the plate 38 onthe other hand are provided with recesses 34 and 35, respectively, of V-form on the sides thereof which are directed toward one another (see FIG. 2). The plates 31 and 32 are carried by a horizontally movable member 36 having a coupling point 37 to which there is connected a coupling-rod 38 partially indicated by a chain-dotted line. The coupling-rod 38 is in turn connected to an arm 39 which can pivot about a fixed hinge-pin 40 and which carries a cam-following roller 41 on its outer end. This cam-following roller 41 operatively engages the periphery of the cam 42 (see also FIG. 2 wherein the hinge-pin 40 has been deleted in the interests of clarity).

Figure 3:
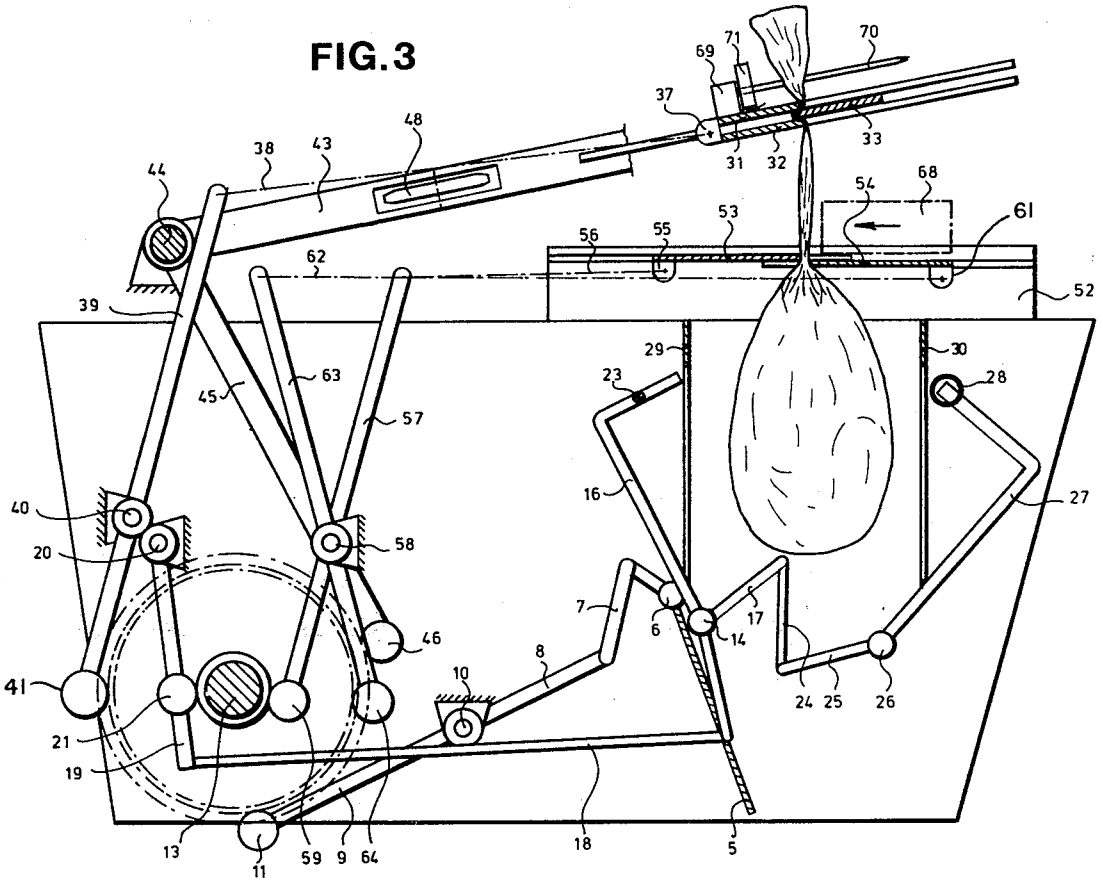
FIG. 3 illustrates a view of the apparatus corresponding to that of FIG. 1 but in another condition of operation.
Figure 4:
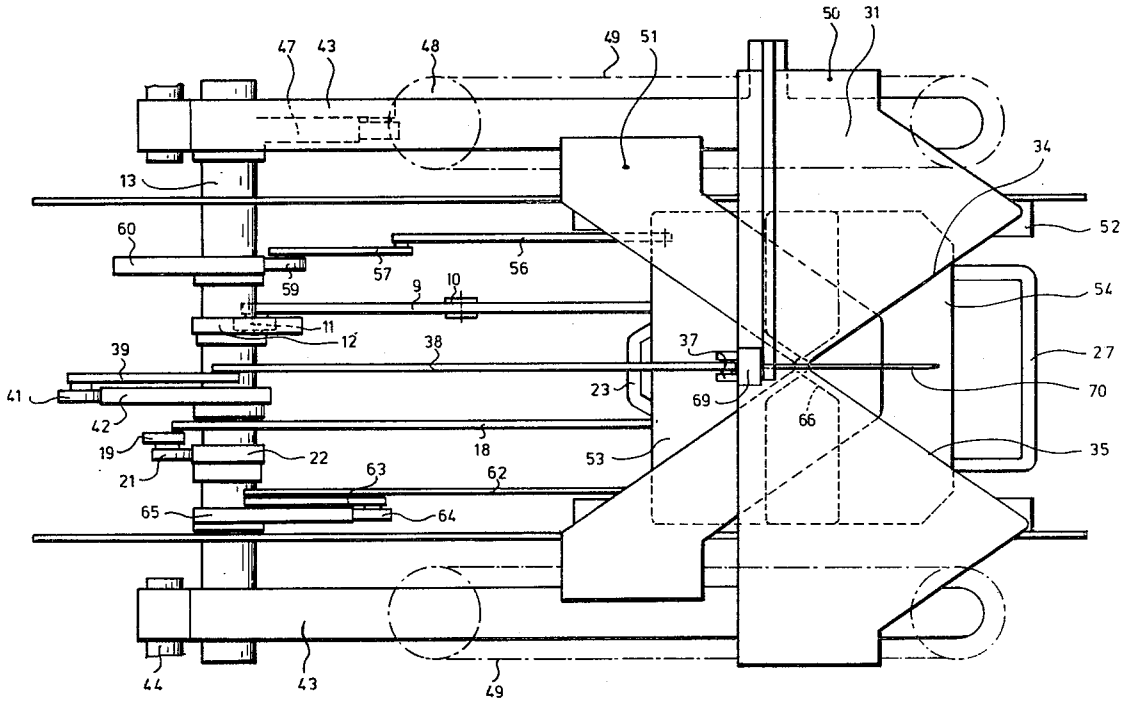
FIG. 4 is a plane view of FIG. 3.

The movable member 36, with the plates 31 and 32 on one side and the plate 33 on the other side, is carried by carriage 43 which can pivot on a fixed shaft 44 which is affixed to an arm 45 carrying a cam-following roller 46. This cam-following roller 46 operatively engages the periphery of the cam 47 (see FIG. 2). Through the rotation of this last mentioned cam 47, the carriage 43 pivots from the position shown in FIG. 1 to the position shown in FIG. 3 and back again.

On each side thereof, the carriage 43 supports two freely rotatable sprocket-wheels or pully-wheels 48 over which a chain 49 or belt is constrained to run (see FIG. 2). Each of the chains or belts 49 is affixed to the plates 31 and 33 at the points 50 and 51 thereon respectively, and through which arrangement movement of the plate 31 (and thus also movement of plate 32) to the right leads to movement of the plate 33 to the left and vice-versa.

The plates 53 and 54 of a pair of plates are arranged on fixed carrier 52 for sliding displacement with respect thereto in the horizontal direction. The plate 53 is connected to a coupling-rod 56 shown partially as a chain-dotted line, at a connecting point 55 therefor. The coupling rod 56 is pivotably connected in turn to an arm 57 which is also pivotable on a fixed hinge-pin 58 and which carries a cam-following roller 59 on its free-end, this cam-following roller 59 operatively engaging the periphery of a cam 60.

The second one of the plates, slidably mounted on the carrier 52 therefor and designated 54, is connected to a coupling-point 61 to which there is affixed a coupling-rod 62, partially indicated by a chain-dotted line. The coupling-rod 62 is connected to an arm 63 which can pivot about the hinge-pin coinciding with that indicated by the reference numeral 58 in FIGS. 1 and 3 and which carries a cam-following roller 64 at its free-end. The cam-following roller 64 operatively engages the periphery of the cam 65. The plates 53 and 54 are provided with recesses of V-form on the sides thereof directed toward one another, which recesses are indicated by the reference numerals 66 and 67, respectively, (see FIG. 2).

Apparatus 68 of a known type is movably arranged above the plates 53 and 54. This apparatus 68 is equipped to close the bunched upper portion of a bag by application thereto of an adhesive tape or strip, and further to cut off that portion of the bag extending above the closed portion. Such apparatus is commercially obtainable.

There is further mounted on the plate 31 a block 69 carrying a pointed pin 70. This pin is enabled to slide in a hole through a divesting member 71 which is affixed to the carriage 43.

The operation of the apparatus is now to be described with reference to FIG. 5 which graphically illustrates the rise, dwell and fall periods of the cams 12, 22, 42, 47, 60 and 65 which are obtainable due to the changes in the radial dimensions thereof during an operating cycle in which they rotate through an angle of 360°. It should be noted that the motions imparted to the hook 1 and the bag-closing apparatus 68 are indicated by the chain-lines designated b and g, respectively. These motions are not directly imparted from the cam shaft 13 but are synchronised to co-incide with motions imparted to other members by the cams accomodated on this shaft.

Figure 5:
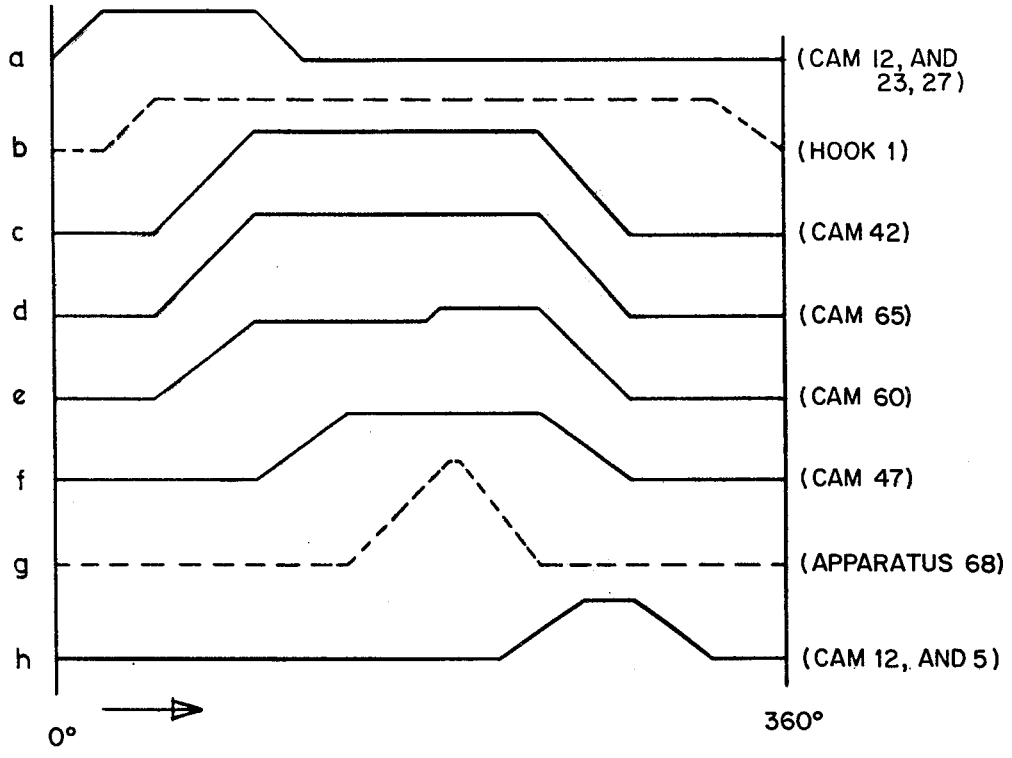
FIG. 5 is a group which illustrates the operation of various members of the apparatus illustrated in FIGS. 1 to 4 in relation to a time-cycle.

The line a in FIG. 5 is representative of the motion imparted by cam 12 to forked-member 23 and the arm-carrier 27 carrying the tension-spring 28. During the first 25° of rotation of the cam shaft 13, the motion imparted by cam 12 causes the forked-arm 23 and the carrier-arm 27 to pivot inward to the positions indicated by the reference numerals 23' and 27' in FIG. 1. During the rotation of cam 12 through the following 75° no motion is imparted to either the forked-member 23 or the carrier arm 27 and consequently these dwell in the positions indicated by the reference numerals 23' and 27'.

The chain-line b is indicative of the upward movement of the hook 1 during the period in which the cam shaft 13 rotates from through the 25° to 50° portion of the 360° cycle, and which movement of the hook 1 takes place after its release from engagement with the leg joints 4 of the item of poultry. Since the members 23 and 27 firmly grip the legs of the items of poultry, the latter cannot be hoisted upward by the hook 1.

Line c is indicative of the motion imparted by the cam 42 and shows that, during the period in which the cam 42 is rotated from 50° to 100°, the plates 31 and 32 on one side and plate 33 on the other are moved toward one another. On by termination of this movement of the plates, they dwell in the positions to which they have been moved until the cam has rotated to 240°. Thereafter, these plates move apart to return to their initial positions during rotation of the cam 42 from 240° to 285°.

Referring now to the line d, which is indicative of the motion imparted by the cam 65, this shows that during the period in which the cam 65 is rotated from 50° to 100°, the plate 54 is moved to its inward position. After having achieved this movement, the plate 54 dwells in the terminal position until the cam 65 has rotated to 240°. Thereafter the plate 65 is moved back to its initial position during rotation of the cam 65 from 240° to 285°.

Referring on now to line e, which is indicative of the motion imparted by cam 60. This shows that during rotation of the cam 60 from 50° to 100°, the plate 53 is moved almost to its unwardmost position. Thereafter, the plate 53 dwells in this position during rotation of cam 60 from 100° to 185°. On further rotation of the cam 60 from 185° to 190°, the plate 53 moves the rest of the way to its inwardmost position in which position this plate dwells until the cam has rotated to 240°. The plate 53 returns to its initial position during further rotation of cam 60 from 240° to 285°.

The line f is indicative of the motion imparted by the cam 47 in its action of pivoting the carriage 43 and shows that during the period in which the cam 47 rotates from 100° to 145°, the carriage 43 is pivotted to its highest position and is maintained in this position during rotation of the cam 47 from 145° to 240°. Thereafter, the carriage 43 is pivotted back to its initial position through further rotation of the cam 47 from 240° to 285°.

The chain-line g is indicative of the operation of the bag-closing apparatus 68 in which the rise in the chain-line corresponds to a displacement leftward in FIGS. 1 and 2.

Lastly, the line h is indicative of the motion imparted by the cam 12 to the bottom member 5 and which action causes the latter to pivot downward during rotation of the cam 12 from 220° to 260°, thereafter to dwell in this downward pivotted position during rotation of the cam from 260° to 285° and after that to pivot the bottom member back upward to its initial position.

It naturally follows the foregoing described and illustrated motions imparted to the various integers by the cams as functions of time, are arbitrary and can be modified; the motions illustrated serve only to establish the relative positions of the various operative integers as functions of time during an operating cycle for a particular embodiment of the invention which has been found to work efficiently in practice.

The operation of the apparatus will be clear from the foregoing description hereof.

Firstly, the forked-member 23 and the arm-carrier 27 constituting the holding members come into operation. When these members have reached their closed positions the hook 1 is pulled back. As soon as these actions have been effected, the set of plates 31 and 32 and the plate 33 move toward each other until they have completely bunched the upper portion of the bag together and firmly hold the bunched portion in this condition.

Simultaneously with these last mentioned actions the plates 53 and 54 move toward one another. However, the plate 53 does not entirely reach its inwardmost position. This intermediate condition of plates 53 and 54 still enables the bag to slide through between plates 53 and 54, while the content of the bag, in this case an item of poultry, remains beneath the plates 53 and 54.

Following this the cam 47 is operative to pivot the carrier 43 upward. This action causes the bag to be pulled taut over its content and even more so since the vertexes of the V-form recesses in the plates 31, on the one hand and 33 on the other hand are just pushed horizontally past one another so that they very firmly grip the bag. In order to prevent the bag from being cut into by these plate members, the edges of the V-form recesses can be rounded-off or chamfered at these locations.

On the commencement of the movement of the set of plates 31, 32 and 33 up and away from the set of plates 53 and 54, the vertexes of the recesses 66 and 67 are still slightly spaced from one another, as a result of which the bag can still slide therebetween. Thereafter these plates 53 and 54 move a little more toward one another. This action results in the bag being pulled even more taut over the content thereof.

In the meantime, the pointed pin 70 pierces the upper end of the bag and this upper portion thereof remains hanging on pin 70 when the apparatus 68 comes into operation to close the bag and sever the upper end free thereof.

When the apparatus reverts back to its initial operative condition, the pin 70 is withdrawn with respect to the divesting member 71 by reason of which the upper end of the bag is released from the pin. Possible retention of the bag on the plates 31 and 32 through adhesion is prevented by the fact that these plates are constrained to move leftward with respect to the divesting member 71.

Finally the bag, with the contents sealed therein and over which the bag has been tautly drawn, is discharged downwardly through the space vacated by the bottom member 5.

At this final stage, the apparatus has reached its initial operative condition from which a new operative cycle can be commenced once more.

What we claim is:

1. A bag closing apparatus provided with a first set of gripping members for handling the open end of a bag, said first set of gripping members comprising two essentially parallel plates having essentially aligned V-shaped edges and arranged in mutually spaced relationship, a third plate having a V-shaped edge and movable parallel to the movement of the first mentioned plates in the space between the said first mentioned plates, the V's of the said V-shaped edges of the first mentioned two plates on the one hand and the V of the V-shaped edges of the third plate on the other hand being open towards each other, the direction of movement of all of said plates coinciding with the axis of symmetry of said V's, the said movement being from a first position in which the vertexes of the V-shaped edges are spaced apart sufficiently to permit the open end of a bag to pass therethrough to a second position in which the vertexes of the V's are very near to each other, a second set of gripping members located on the side of the first set toward the bag, said second set of gripping members including a plate having a V-shaped edge and a further plate with a V-shaped edge, the plates of the second set being essentially parallel to those of the first set, the V's of said edges of the second set being open towards each other, the plates of the second set being movable with respect to each other in the direction of the axis of symmetry of the V's of the second set from a first position in which the vertexes of the V-shaped edges are spaced apart a sufficient amount to permit the top of the bag to pass therebetween, to a second position in which the Vertexes of the V's are nearer to each other than in the first position, and means for moving said first set of gripping members with respect to the second set of gripping members in a direction generally perpendicular to the plane of said plates, and a bag closing means operable at a location between the first and second sets of plates after the sets have been moved apart.

2. A bag closing apparatus according to claim 1, including drive means for driving the third plate of the first set in direct response to movement of the first two said parallel plates of the first set.

3. A bag closing apparatus according to claim 2, in which the plates of the first set are chamfered at the vertexes of the recesses, and said drive means operatively engages said plates such that shortly before the second position of the first set of gripping members is attained the vertexes of the V's thereof overlie each other and in the said second position the vertex parts of the V-shaped edges of the third plate have passed the vertexes of the first two said parallel plates.

4. An apparatus according to any one of claim 1, 2 or 3, in which the said second set of gripping members are movable to an intermediate position while the first gripping members are at their second position and before the second set has moved to its second position, at which intermediate position the V's of the second set are spaced apart an amount sufficient to bunch the top portion of the bag together while permitting the bag to slip therethrough.

5. A bag closing apparatus according to any one of claims 1, 2 or 3, wherein the means for moving the first set of gripping members with respect to the second set comprises means for turning the gripping members of the first set about an axis parallel to said plates.

6. A bag closing apparatus according to any one of claims 1, 2 or 3, including means for severing the top portion of the bag above the location at which the bag is closed by the closing means, and including a pin means mounted on the first set of gripping members for engaging and removing the severed upper end of the bag.

7. A bag closing apparatus according to claim 6, said pin means comprising a pin movable with one of the plates of the first set of gripping members to pierce the severed upper portion of the bag, and means for stripping said upper portion of the bag from the pin for discarding of same as the plates of the first set of gripping members separate from each other.

* * * * *